United States Patent [19]

Chambley et al.

[11] 4,119,826

[45] Oct. 10, 1978

[54] DIELECTRIC HEAT GENERATOR

[75] Inventors: Phillip Wayne Chambley; Alan Hedley Norris, both of Rome, Ga.

[73] Assignee: Champion International Corporation, Stamford, Conn.

[21] Appl. No.: 784,577

[22] Filed: Apr. 4, 1977

[51] Int. Cl.[2] ..... H05B 9/04

[52] U.S. Cl. ..... 219/10.81

[58] Field of Search ..... 219/10.81, 10.75, 10.41; 156/273

[56] References Cited

U.S. PATENT DOCUMENTS

| | | | |
|---|---|---|---|
| 2,298,038 | 10/1942 | Crandell | 219/10.81 |
| 2,540,613 | 2/1951 | Foley et al. | 219/10.81 |
| 2,582,806 | 1/1952 | Nes et al. | 219/10.81 |
| 2,802,085 | 8/1957 | Rothacker | 219/10.81 |
| 2,813,184 | 11/1957 | Rueggeberg | 219/10.81 |
| 3,160,687 | 12/1964 | Andrews | 219/10.81 |
| 3,866,255 | 2/1975 | Serota | 219/10.81 |

*Primary Examiner*—Bruce A. Reynolds
*Attorney, Agent, or Firm*—Evelyn M. Sommer

[57] ABSTRACT

A dielectric heat generator in which radio frequency energy derived from a radio frequency oscillator is divided into two separate ratio frequency components which are equal but out of phase with each other. Each component is applied to a separate electrode. In one embodiment the two components are essentially 180° out of phase and each component is applied to a different one of two electrodes that are positioned in tandem and facing a third electrode which is coupled to ground. In a second embodiment, the components are essentially 180° out of phase and each component is applied to a different one of two electrodes that are facing each other and spaced apart from each other. In a third embodiment, the two components are essentially 90° out of phase and are applied to an arrangement of finger electrodes.

2 Claims, 4 Drawing Figures

DIELECTRIC HEAT GENERATOR

BACKGROUND OF THE INVENTION

This invention relates to dielectric heat generators, and more particularly, this invention relates to electrode systems for dielectric heat generators.

Dielectric heat generators are well known in the art and widely used for preheating in the molding of plastics, for quick heating of thermosetting glues in cabinet and furniture making and in a variety of other industrial applications where heating must be introduced uniformly throughout electrically nonconductive materials. In copending patent application Ser. No. 724,600, abandoned, there is described a method and apparatus wherein a dielectric heat generator is employed for heat setting and heat shrinking synthetic-resin yarn and in U.S. Pat. No. 2,433,842 there is described a method wherein a rayon filament is dried by subjecting the filament to radio frequency oscillation.

Conventional dielectric heat generators contain a radio frequency oscillator which produces high frequency sine-wave energy. In some types of dielectric heat generators the material being heated is placed directly between the plates of the capacitor in the tank circuit in the oscillator. In most dielectric heat generators, however, the oscillator is coupled to an external electrode system. The electrode system is usually made up of two electrodes, one coupled through an inductance to the oscillator and the other connected to ground. The physical dimensions of the capacitor which comprises the power electrodes are calculable from the formula:

$$C = 0.224\ KA/S;$$

where $C$ is the electrical capacitance in picofarads needed to resonate with the inductance in the circuit at the operating frequency, $K$ is the dielectric constant of the material between the electrodes, $A$ is the area in square inches of each one of the electrode faces, and $S$ is the spacing distance in inches between the two electrodes.

Theoretically, the electrodes can be as large or long as desired, the only requirement being that the inductance in the tuned circuit be sufficient for resonance of the system.

From a practical standpoint, however, there is an upper limit to the size of the electrodes, which is caused by development of standing waves on the electrode plates. At some fraction of a wavelength, generally recognized as about 1/10–1/12 $\lambda$, the electrodes begin to behave as an antenna. It is simultaneously resonant in the system as a capacitor, and loadable from the system as a radiating device. At and beyond this point, the voltage and current waveforms, along the "antenna", create hot and cool spots over the length of the electrode, and drying (heating) uniformity is much reduced. Depending on the degree to which the "antenna" is loaded, there is also a power loss due to radiation.

SUMMARY OF THE INVENTION

It is an object of this invention to provide a new and improved dielectric heat generator.

It is another object of this invention to provide a new and improved electrode system for a dielectric heat generator.

It is still another object of this invention to provide a novel technique for increasing the size of the electrodes in a dielectric heat generator.

It is yet still another object of this invention to provide an electrode system for a dielectric heat generator that makes available more dielectric line paths through approximately the same area of material being dried.

It is another object of this invention to provide a novel arrangement for doubling the electromotive force field on the electrodes in a dielectric heat generator.

It is still another object of this invention to provide a technique for improving the efficiency of a dielectric heat generator.

This invention is based on the idea of using appropriately designed phase shifting networks to divide the radio frequency energy from the oscillator into two separate components which are equal but out of phase with each other and then applying each component to a separate electrode. The invention is based on the understanding that the output waveform of a radio frequency oscillator is generally sinusoidal, that the output changes from positive to negative and back once per cycle and that the resulting oscillations of polarity on the electrodes in a dielectric generator is what causes the dipolar strains on the molecules of the dielectric material being treated and generates heat.

A dielectric heat generator constructed according to this invention includes a radio frequency oscillator and an electrode system which is coupled to the radio frequency oscillator. The electrode system includes a phase shifting network which splits the energy received from the radio frequency oscillator into two equal components.

In a first embodiment of the invention, the radio frequency energy from the oscillator is split into two equal components, one essentially 180° out of phase with the other, and each component is applied to a different one of two electrodes. These two electrodes are positioned in tandem and facing a third electrode which is connected to ground. In a second embodiment of the invention, the radio frequency energy from the oscillator is split into two equal components, one essentially 180° out of phase with the other and each component is applied to a different one of two spaced apart, facing electrodes. In a third embodiment of the invention the radio frequency output from the oscillator is divided into two equal components, one essentially 90° out of phase with the other and the two components are applied to a stray field type electrode system, appropriately modified.

It is to be noted that although the radio frequency output from the oscillator has been described to be essentially 90° or 180°, any multiple thereof would work equally as well. Also, it is to be understood that the exact value of the phase relationship is not critical but rather that the radio frequency output be divided into two components of different phase relationships (out of phase).

The foregoing and other objects and advantages will appear from the description to follow. In the description, reference is made to the accompanying drawings which form a part thereof, and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described by way of examples with reference to the drawings wherein like reference numerals represent like parts and wherein.

DESCRIPTION OF PREFERRED EMBODIMENTS

Figure 1:
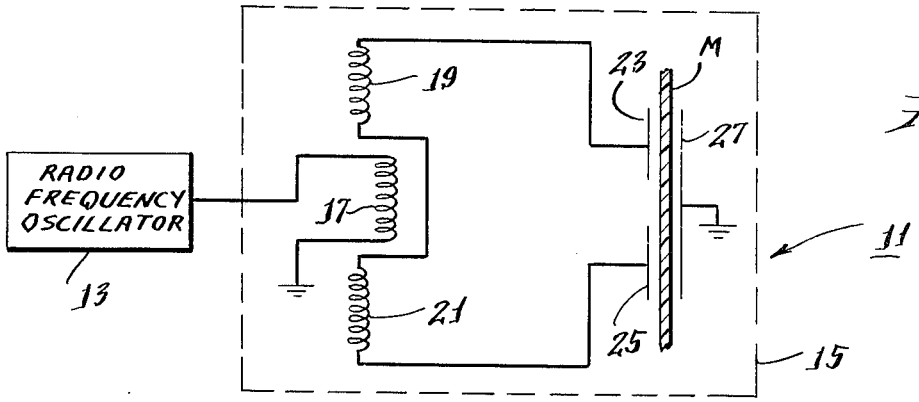
FIG. 1 is a circuit diagram of a first embodiment of a dielectric heat generator constructed according to this invention.

Referring now to the drawings, there is shown in FIG. 1 a dielectric heat generator constructed according to this invention and identified generally by reference numeral 11. Dielectric heat generator 11 includes a high voltage r.f. oscillator 13. Energy is extracted from oscillator 13 from a plate (not shown) positioned midway between the plates of the capacitor of the tank circuit (not shown) in the oscillator. Oscillator 13 is connected to a suitable power supply (not shown). The energy extracted from oscillator 13 is fed into a balanced center fed electrode system 15. The electrode system 15 includes a transformer having a primary winding 17, a first secondary winding 19 and a second secondary winding 21. Primary winding 17 is connected at one end to the oscillator 13 and at the other end to ground. One end of secondary winding 19 is connected to electrode 23 and one end of secondary winding 21 is connected to electrode 25. The other ends of the two secondary windings 19, 21 are connected together. Electrodes 23 and 25 are positioned in tandem. A third electrode 27 is positioned across from electrodes 23 and 25 and is connected to ground.

The material M to be heated is placed in the space between the electrodes. At any instant the voltages at electrodes 23 and 25 are equal but opposite in polarity (i.e. essentially 180° out of phase with each other). Since the two electrodes 23 and 25 taken together are twice the size of the one electrode, there is an increase in material throughput since more power can be concentrated to heat the material.

Figure 2:
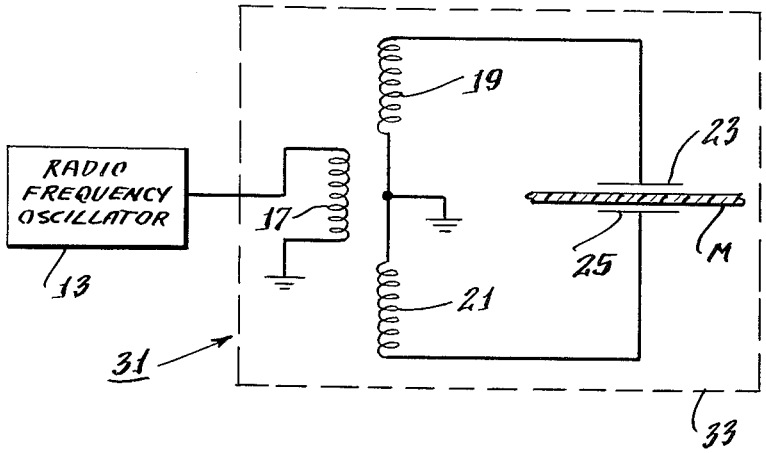
FIG. 2 is a circuit diagram of a second embodiment of a dielectic heat generator constructed according to this invention.

The embodiment identified by reference numeral 31 in FIG. 2 differs structurally from the embodiment in FIG. 1 in that in electrode system 33 there is a center tap to ground between secondary windings 19 and 21, electrodes 23 and 25 are positioned facing each other and there is no ground electrode. By grounding the center tap of the secondary winding both electrodes 23 and 25 can be left above ground. Consequently the field voltage gradient across electrodes 23 and 25 is doubled. Since the heat generated in a dielectric material is proportional to (among other things) the square of the field voltage, the amount of useful power (heat) that can be "focused" on the material being heated is increased by a factor of four.

Figure 3:
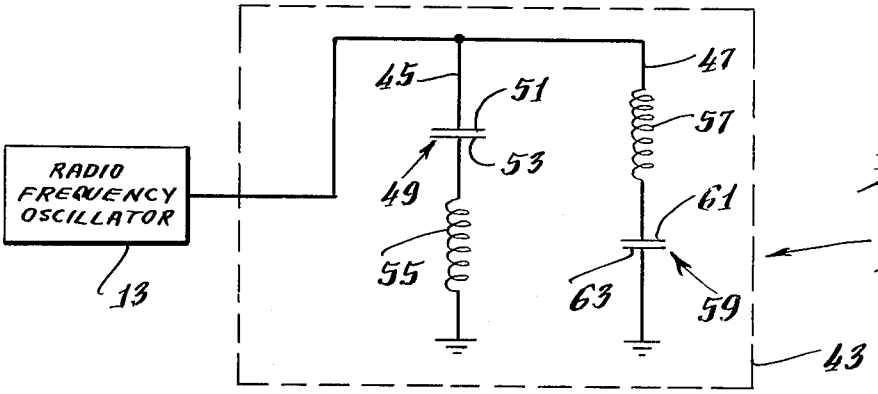
FIG. 3 is a circuit diagram of a third embodiment of a heater electrode system constructed according to this invention.

Referring now to FIG. 3 there is shown a third embodiment of the invention identified generally by reference numeral 41. In this embodiment radio frequency energy from radio frequency oscillator 13 is fed into electrode system 43 where it is divided into two equal components travelling along separate paths 45 and 47.

Figure 4:
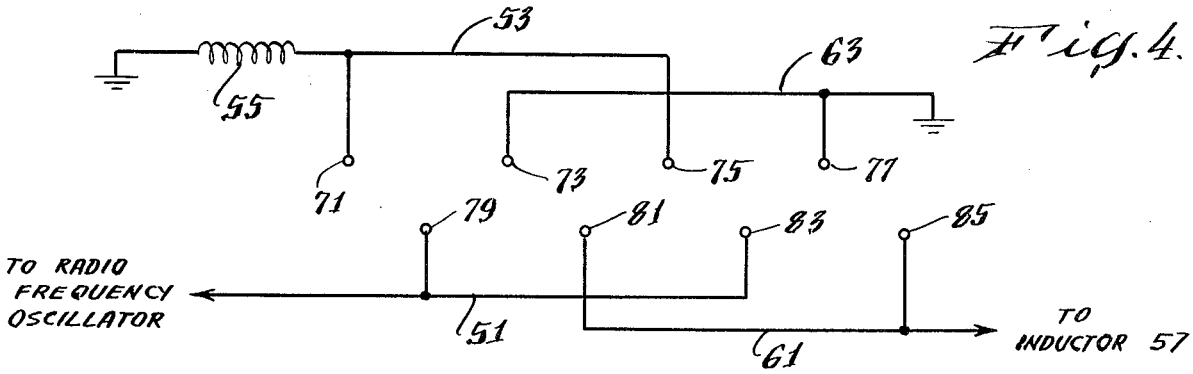
FIG. 4 is a diagrammatic view showing how the electrodes in the embodiment in FIG. 3 are physically positioned with respect to each other.

Path 45 includes a capacitor 49 having plates 51 and 53. Capacitor 49 is connected in series with an inductor 55 which, in turn, is connected to ground. Path 47 includes an inductor 57 which is connected in series with a capacitor 59 having plates 61 and 63 and which, in turn, is connected to ground. In this circuit arrangement the energy reaching plate 51 of capacitor 49 is essentially 90° out of phase with the energy reaching plate 61 of capacitor 59. The circuit is suited for coupling to a system of finger electrodes in which the heating is performed through the utilization of the stray field that extends outside the direct line between the electrodes. The physical arrangement of the finger electrodes is shown in FIG. 4. As can be seen plate 53 is coupled to finger electrodes 71, 75; plate 63 is coupled to finger electrodes 73, 77; plate 51 is coupled to finger electrodes 79, 83; and plate 61 is coupled to finger electrodes 81 and 85. With this arrangement there are two different sets of dielectric paths treating the material being heated, with each set changing polarity at the same frequency rate as before, but the electrodes are no longer inoperative for half the time. The result is that twice the energy can be absorbed by the material, generating twice the heat, which again facilitates a commensurate increase in material throughput rate.

In all three electrode systems there is an energy saving due to the oscillator anode being operated at more than its normal input curve. Therefore, the only increase in consumed power is that which occurs in the anode system of the oscillator. The power to light filaments, generate operating bias and operate control systems remains the same.

It will be understood that various changes in the details, materials, arrangements of parts and operating conditions which have been herein described and illustrated in order to explain the nature of the invention may be made by those skilled in the art within the principles and scope of the invention.

What is claimed is:

1. An electrode system for a dielectric heat generator including a radio frequency oscillator comprising:

a first electrical circuit connected between the oscillator output and ground, comprising the series combination of a first capacitive electrode array and a first inductor, one terminal of said first capacitive array being connected to the oscillator output and one terminal of said first inductor being connected to ground;

a second electrical circuit connected between the oscillator output and ground, comprising the series combination of a second capacitive electrode array and a second inductor, one terminal of said second capacitive array being connected to ground and one terminal of said second inductor being connected to the oscillator output;

said first capacitive electrode array comprising first and second sets of finger electrodes located on opposite sides of a material to be dielectrically heated;

said second capacitive electrode array comprising third and fourth sets of finger electrodes located on opposite sides of the material to be dielectrically heated.

2. An electrode system as defined in claim 1 wherein the electrodes in said first and third sets alternate with one another on the same side of the material to be dielectrically heated while the electrodes in said second and third sets alternate with one another on the opposite side of the material.

* * * * *